US005715760A

United States Patent [19]

Frascaroli et al.

[11] Patent Number: 5,715,760

[45] Date of Patent: Feb. 10, 1998

[54] MODULAR FURNITURE SYSTEM, PARTICULARLY FOR OFFICES, COMPRISING SELF-SUPPORTING, MULTIFUNCTIONAL COLUMNS

[75] Inventors: Francesco Frascaroli; Gianluigi Lolli, both of Bologna, Italy

[73] Assignee: Castelli S.p.A., Bologna, Italy

[21] Appl. No.: 398,511

[22] Filed: Mar. 3, 1995

[30] Foreign Application Priority Data

Mar. 4, 1994 [IT] Italy ..... B094A0081

[51] Int. Cl.[6] ..... A47B 83/00

[52] U.S. Cl. ..... 108/50; 108/153; 108/180; 312/111; 312/265.1; 312/265.5; 312/108

[58] Field of Search ..... 108/50, 153, 180, 108/182, 186, 193; 312/194, 195, 198, 265.1, 265.2, 265.3, 265.5, 108, 111

[56] References Cited

U.S. PATENT DOCUMENTS

| | | | |
|---|---|---|---|
| 3,250,584 | 5/1966 | Tassell | 312/111 X |
| 4,163,537 | 8/1979 | Mourgue | 108/153 X |
| 5,477,594 | 12/1995 | LePage | 312/108 X |

FOREIGN PATENT DOCUMENTS

| | | | |
|---|---|---|---|
| 2436439 | 12/1976 | Germany | 312/265.5 |
| 2856443 | 7/1980 | Germany | 312/111 |
| 2914854 | 10/1980 | Germany | 108/180 |
| 3331173 | 3/1985 | Germany | 312/265.5 |
| 3405591 | 8/1985 | Germany | 108/180 |
| 3405862 | 8/1985 | Germany | 108/180 |
| 2061092 | 5/1981 | United Kingdom | 312/111 |
| 2156206 | 10/1985 | United Kingdom | 108/153 |
| 8203540 | 10/1982 | WIPO | 312/265.1 |

*Primary Examiner*—Peter M. Cuomo
*Assistant Examiner*—Rodney B. White
*Attorney, Agent, or Firm*—Sughrue, Mion, Zinn, Macpeak & Seas

[57] ABSTRACT

The modular furniture system, particularly for offices, comprises at least one column-like upright element having a vertically elongate body and a plurality of fixtures which can be coupled selectively to the two ends and to the body of the upright to form a furniture arrangement. The vertical positions of the fixtures coupled to the body of tile upright can be adjusted continuously to achieve different heights for components such as work surfaces, shelves, suspended units, screens, lighting equipment and the like. The upright is self-supporting and permits multiple connection of fixtures which are independent of one another.

4 Claims, 7 Drawing Sheets

MODULAR FURNITURE SYSTEM, PARTICULARLY FOR OFFICES, COMPRISING SELF-SUPPORTING, MULTIFUNCTIONAL COLUMNS

BACKGROUND OF THE INVENTION

The present invention relates to a modular furniture system, particularly for offices.

Modular office furniture systems comprising a plurality of uprights interconnected by cross-members so as together to form a support framework which is equipped with work surfaces, screens and partition walls are known.

A disadvantage of known modular systems is that the cross-members interconnecting the uprights have to be very strong in order to withstand the stresses exerted on the support frame in use. In other words, the load-bearing structure of known furniture systems is constituted by the base frame as a whole, necessarily including the assembly of uprights and cross-members.

Another disadvantage of the known modular systems indicated above is that they have a limited degree of adaptability to specific furniture arrangements since they generally allow fixtures to be fitted solely in predetermined positions in relation to the height of the structure.

A further disadvantage of known modular systems is that it is impossible to form branches from the basic framework, for example, to form complex divisions of the spaces to be furnished without the need to duplicate the uprights at the junctions of the branches, consequently increasing the bulk of the furniture system and its overall cost.

Moreover, known modular systems do not allow the various furniture accessories in an assembled arrangement to be fully independent since the addition, removal or repositioning of one of these accessories usually necessitates the disassembly of a substantial portion of the furniture arrangement.

SUMMARY OF THE INVENTION

The object of the present invention is to overcome tile disadvantages of known modular furniture systems, by providing a modular furniture system or assembly the support structure of which does not necessitate the use of cross-members with structural functions, which is highly flexible, permitting tile formation of a wide range of sets of furniture, and which is simple and cheap to manufacture and assemble, ensuring that a furniture arrangement can easily be modified by the addition, elimination or repositioning of furniture even at a time after the formation of a basic set of furniture.

In order to achieve the objects explained above, the subject of the present invention is a modular furniture system, particularly for offices, comprising:

BRIEF DESCRIPTION OF THE DRAWINGS at least one column-like upright element having a body which is elongate along a principal axis and two opposite ends substantially perpendicular to the principal axis, a plurality of fixtures which can be coupled selectively to the ends or to the body of the at least one upright element to form a furniture arrangement, the positions in which the fixtures are coupled to the body of the upright element being adjustable continuously along the principal axis.

An advantage of tile present invention is that it provides a modular furniture system in which the number of components having structural functions is reduced to a minimum so as to reduce the costs of forming even a complex furniture arrangement.

Another advantage of the present invention is that it provides a modular furniture system which permits easy assembly of furniture arrangements with branches, both at the initial assembly stage and as a result of the extension of an existing arrangement. This modular system enables fixtures to be fitted and removed without the need to interfere with the other components making up the furniture arrangement since it is possible to form multiple connections which are independent of one another, on the same upright, with the possibility of adjusting the height positions of the fixtures continuously, at the same time ensuring good stability, strength and secure clamping of the furniture arrangement and of the individual components, even after heavy usage and with large stresses over a prolonged period of time.

Further characteristics and advantages will become clear from the description which follows with reference to the appended drawings, given purely by way of non-limiting example, in which:

FIGS. 1 to 3 are perspective views of an example of an office furniture structure using a modular system according to the present invention, in three different stages of assembly, FIG. 4 is a cross-section of an upright of the present invention, showing various types of connection for accessory components, FIG. 5 a cross-section of an upright showing another type of connection, FIGS. 6 to 11 are perspective views of various furniture units formed with the modular system of the present invention, FIG. 12 shows a plurality of work-surface assemblies, schematically and in perspective, FIG. 13 a plan view of a work station, FIG. 14 is an exploded, perspective view of a work surface with an associated screen, showing a plurality of alternatives for the formation of the screen.

FIG. 15 is a schematic front view showing the modular formation of screens of different heights, FIG. 16 is a side view of a set of uprights corresponding to the uprights of FIG. 15, with associated work surfaces.

DETAILED DESCRIPTION OF THE INVENTION

Figures 1, 2, 3:
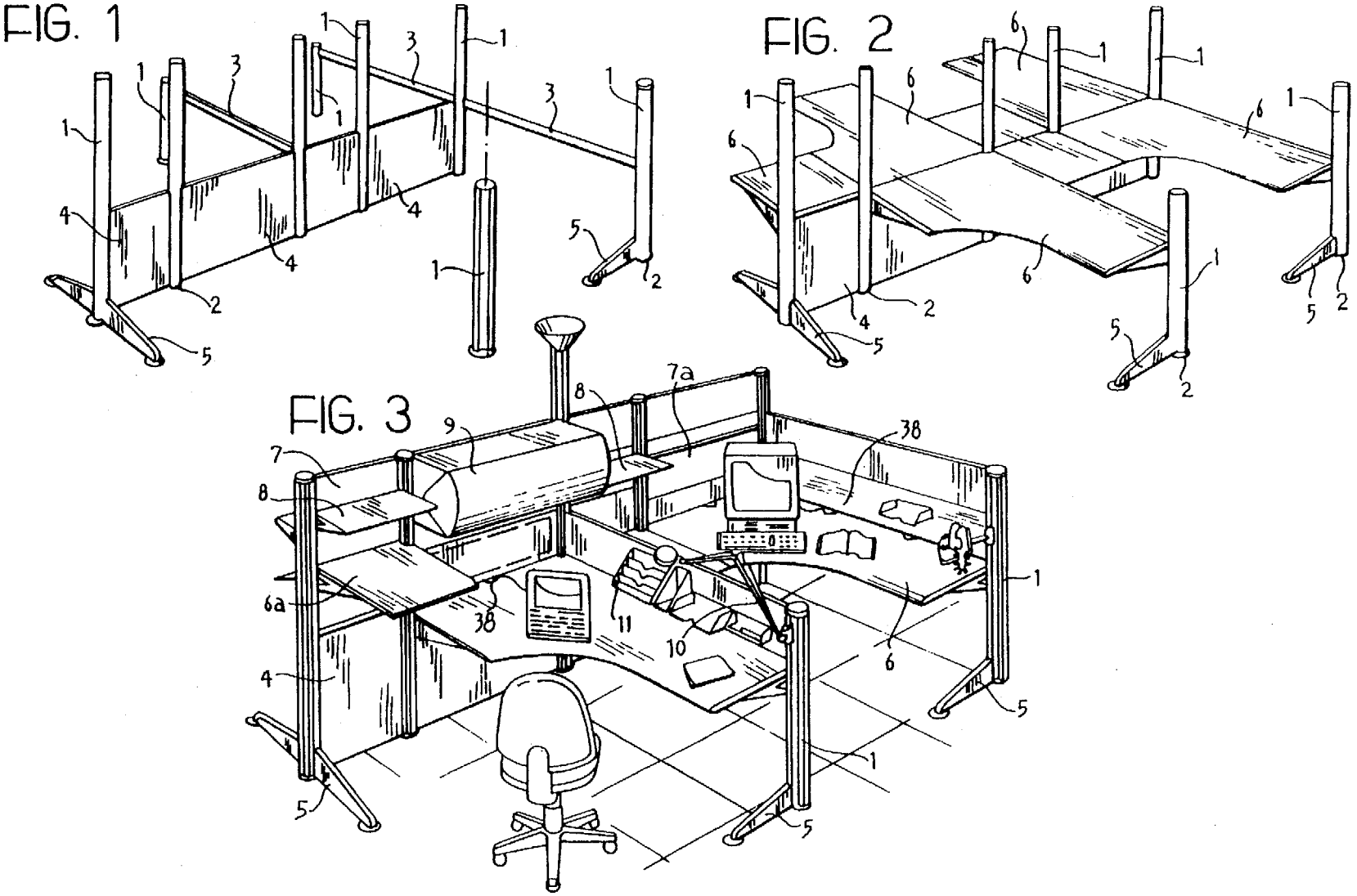

With reference now to FIGS. 1 to 3, a furniture structure designed according to the specific requirements of a particular office is formed by the positioning of column-like uprights 1 of various heights in positions predetermined during the design of the structure and referred to below as nodal points, the ends 2 of the uprights being wide enough to allow the uprights 1 to be disposed vertically even without the aid of structural cross-members. In any case, the distances between the various uprights 1 can be adjusted precisely with the use of spacer elements such as, for example, spacer bars 3 or spacer panels 4. Balancing feet 5 can be connected to the uprights 1 in the positions in which loads which are out of balance with respect to the vertical may be expected.

Work surfaces 6 are then connected to the uprights 1 (FIG. 2) to define, for example, work stations for seated people and, finally, the structure can be completed by various fixtures such as screens 7, shelves 8, suspended units 9, lamps 10, fitted panels 11 and the like to form a complete furniture structure.

The heights of all the fixtures connected to the uprights 1 are adjustable continuously as will become clearer from the following description, so that it is possible, for example, to provide partial separation screens 7*a* or work surfaces 6*a* at personalized heights, either in predetermined fixed positions or in positions which can be adjusted by the user, according to choice.

Figure 4:
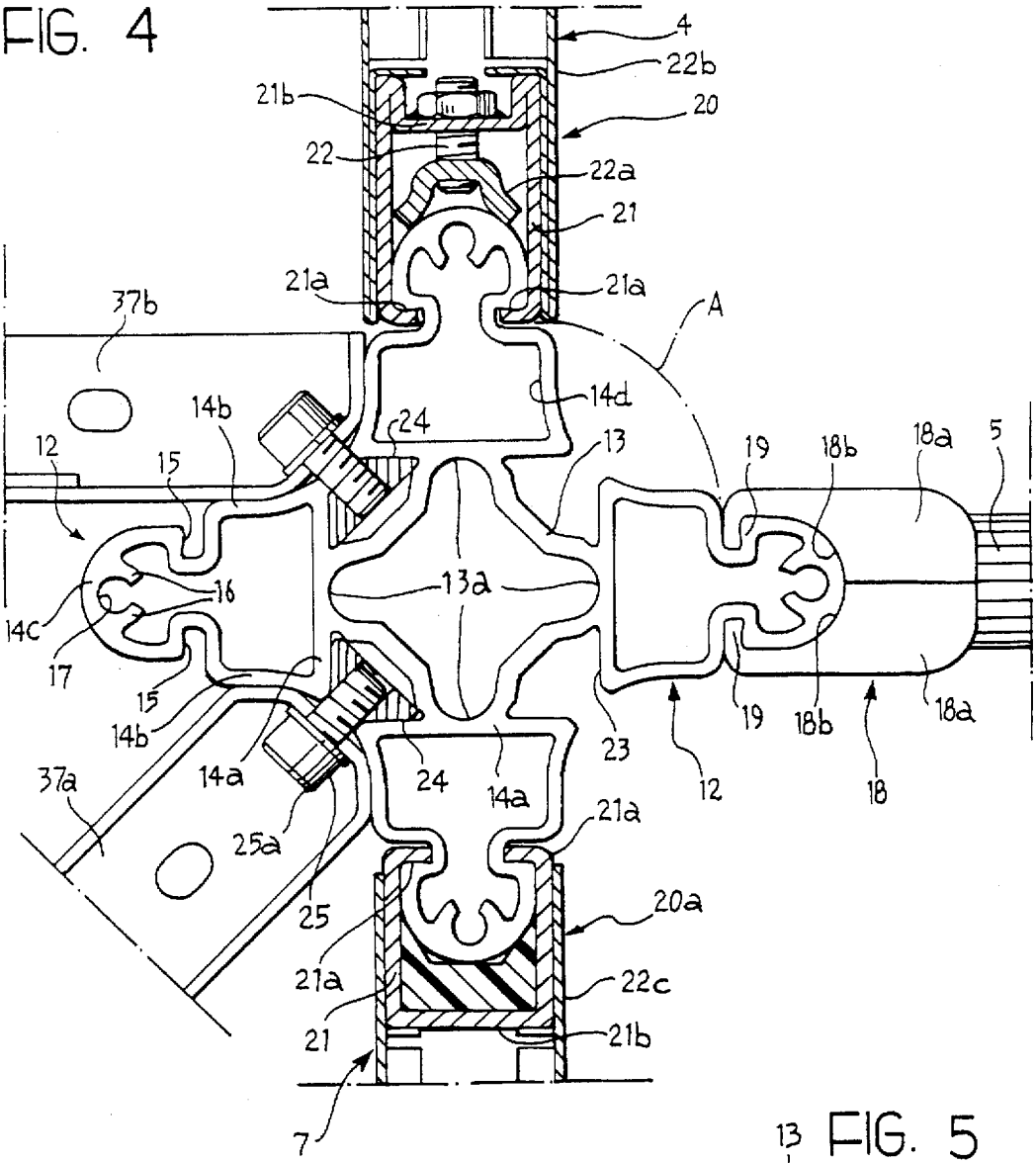

With reference now to FIG. 4, each upright 1, which is preferably formed from an extruded aluminium section or beam, has a cross-shaped overall cross-section with four identical arms 12 disposed radially at 90° to one another, extending from four corresponding lobes 13*a* of a longitudinally hollow central core 13. Each arm 12 has a hollow, bell-shaped cross-section having a base wall 14*a* integral with a respective lobe 13*a* of the central core 13, and two opposite concave sides 14*b*, joined together by an end wall 14*c* with a semicircular cross section, disposed at the end of the arm 12 farthest from the core 13. Essentially, the peripheral profile of the cross-section of the generic upright 1 has a square configuration with rounded corners constituted by the end walls 14*c* together with concave sides constituted by the two sides 14*b* of two adjacent arms 12.

Two opposed longitudinal grooves 15 are formed on the two sides 14*b* of each arm 12. Two curved appendages 16 define a longitudinal channel 17 with a broken circular cross-section on the internal surface of the end wall 14*c*. The base walls 14*a* of two adjacent arms 12 and the portion of the wall of the central core 13 between the two corresponding lobes 13*a* together define a longitudinal slot 23 with a substantially trapezoidal cross-section, the smaller base of which corresponds to the opening of the slot.

The longitudinal edges of a flexible finishing shell A, indicated in chain line in FIG. 4, can be inserted in two facing longitudinal grooves 15 of two adjacent arms 12 so as to define a covered longitudinal chamber through which, for example, electrical or data-transmission cables can extend.

The shape of the upright 1 is such that it can be coupled with a plurality of connection elements, shown by way of example in FIG. 4, for connecting various fixtures to the upright 1 in longitudinal positions which can be selected and adjusted continuously, as shown in the example of a furniture structure in FIG. 3.

In particular, a connection element 18 with jaws which can be associated, for example, with a foot 5, comprises two opposed half-shells 18*a* the complementary clamping surfaces 18*b* of which together reproduce the semicircular profile of the end wall 14*c* of an arm 12. Each half-shell 18*a* terminates in a hooked appendage 19 which, in the fitted condition shown in the drawing, is partially engaged in a corresponding longitudinal groove 15 when the two half-shells are clamped together by means, for example, of screws. In this condition, the clamping surfaces 18*b* grip the end wall 14*c* of the arm 12 like a clamp, clamping the associated fixture, in particular, the foot 5.

A tensile connection element 20 used, for example, for fixing the spacer bars 3 or the spacer panels 4, comprises an engagement element 21 terminating in two appendages 21*a* which can be slid into the longitudinal grooves 15 of an arm 12. A threaded pin 22 mounted in the base wall 21*b* of the engagement element 21 is screwed into a nut 22*b* welded to the base wall 21*b*. A hexagonal seat is formed at one end of the threaded pin 22 for the engagement of a hexagonal key and a pressure element 22*a* is mounted rotatably on the opposite end. Rotation of the pin 22 clamps the pressure element 22*a* against the outer surface of the end wall 14*c*. Naturally, the nut 22*b* and the threaded pin 22 could be replaced by a similar device, for example, such as a cam or eccentric system, which selectively clamps the pressure element 22*a* against the arm 12.

A variant 20*a* of the tensile connection element 20, particularly suitable for the connection of screens 7, also comprises an engagement element 21, the appendages 21*a* of which can be coupled with two respective longitudinal grooves 15. The internal chamber which, in the assembled condition, is defined by the internal walls of the engagement element 21 and the end wall 14*c* of an arm 12 houses a wedge-like pressure element 22*b*, preferably of plastics material, having a flat rear wall which bears on the end wall 21*b* and a substantially C-shaped opposite wall for pushing against the end wall 14*c* of the arm 12. The wedge-like element 22*b* is tapered longitudinally, that is, perpendicular to the plane of the drawing, so that it can be forced releasably against the arm 12 to fix the screen 7 to the upright 1 at a certain height.

Another type of tensile connection element which can be associated with a longitudinal slot 23 comprises an engagement element 24 with a substantially trapezoidal cross-section in which threaded holes are formed for the engagement of tension screws 25. The heads 25*a* of the tension screws 25 are fitted inside hollow portions of fixtures such as brackets 37*a*, 37*b* for supporting work surfaces. The brackets 37*a*, 37*b* can be clamped against the outer surfaces of the sides 14*b* of two adjacent arms 12 by action on the heads 25*a* of the tension screws 25, so that the inclined faces of the engagement element 24 push against corresponding portions of the base walls 14*a* of the two adjacent arms 12.

The orientation of the fixtures associated with the various connection elements shown in FIG. 4 relative to the axes of tile arms 12 of tile generic upright 1 does not depend upon the type of connection element used. In fact, connection elements of the same type can be used for connecting fixtures to the upright 1 in various orientations relative to tile axis of an arm 12, for example, such as the angled bracket 37*a* or the parallel bracket 37*a* shown in FIG. 4. Moreover, for a generic connection element, an articulated joint, for example, a ball-and-socket joint can be connected for the mounting of arms supporting orientable lamps, shelves and the like.

In addition to the possibilities for the longitudinal connection of fixtures to the upright 1 by means of the connection elements shown in FIG. 4, it is also possible to make use of the arrangement of the cross-section of the upright to connect fixtures to the ends of the upright. In particular, the central hollow core 13, the hollow portions 14*d* of the arms 12 and the longitudinal channels 17 can house coupling elements carrying radial expansion means for clamping the coupling elements against the side walls of the cavities.

Figure 5:
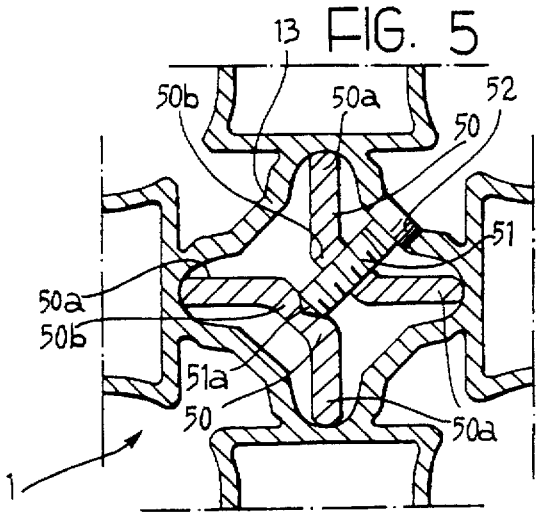

An example of an expansion connection is shown in FIG. 5. Two flexible wings 50, each having two end portions 50*a* disposed at 90° to one another for engaging in adjacent lobes of the central core 13 are fixed to the fixture to be fixed to the end of the upright 1. The ends 50*a* are interconnected by a central portion 50*b* which is oriented at 45° to each of the ends 50*a*. The conical end 51*a* of a transverse pressure grub screw 51 screwed into a threaded hole in one of the central portions 50*b* engages a seat in the other central portion 50*b*. A hexagonal wrench can be inserted through a hole 52 provided at a predetermined distance from the end of the upright 1 to screw or unscrew the grub screw 51 and consequently to clamp or release the expansion connection element inside the cavity of the central core 13.

Moreover, the longitudinal channels 17 may be partially threaded for the threaded connection of fixtures mounted on the ends of the uprights 1.

Figure 6:
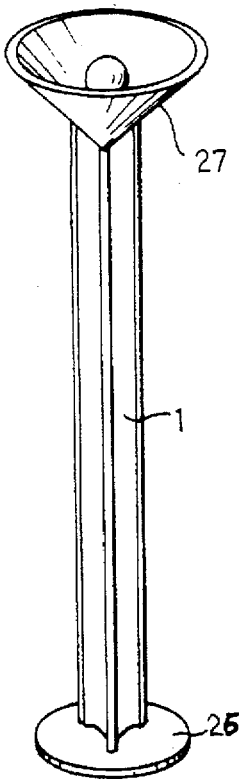

Since each upright element 1 is structurally self-supporting, a single upright may be selected as the basic element for the formation of a minimal furniture arrangement. FIG. 6 shows, by way of example, a set of furniture in a minimal arrangement for forming a standard lamp. A base 26 and a lighting body 27 are connected to the respective ends of the upright 1.

Figure 7:
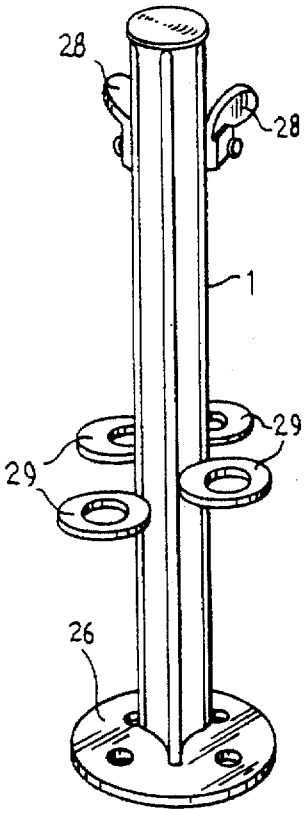

FIG. 7 shows a set of furniture in a minimal arrangement for forming a coat stand, in which coat-hook accessories 28 and umbrella-holder accessories 29 are connected longitudinally, by means of one of the longitudinal connection elements described above with reference to FIG. 4, to the upright 1 provided with the base 26. The heights of the coat-hooks 28 and umbrella-holders 29 are therefore adjustable.

Figure 9:
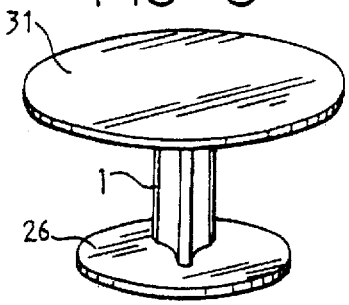
Figure 10:
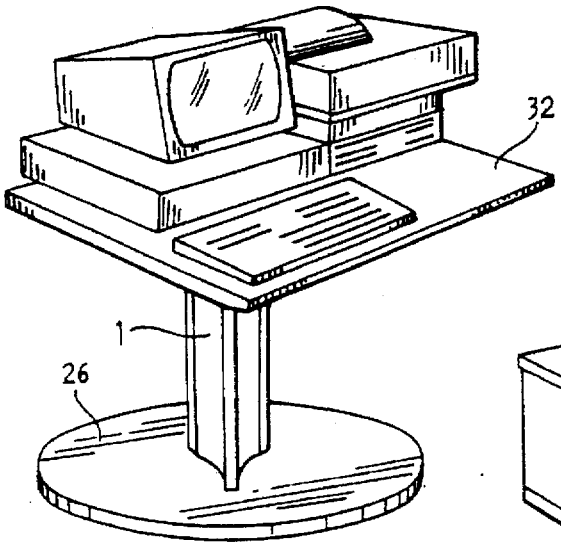
Figure 8:
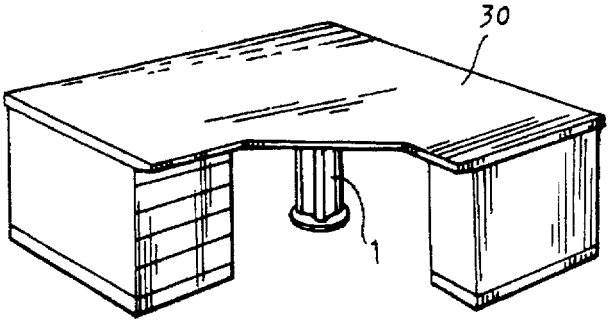

FIGS. 8, 9 and 10 show three examples of tables comprising single uprights 1 and various work surfaces, that is, a shaped surface 30, a round surface 31 and a fitted surface 32 suitable, for example, for holding office machines, respectively. All of the surfaces 30, 31 and 32 are fixed to the tops of the uprights 1.

Figure 11:
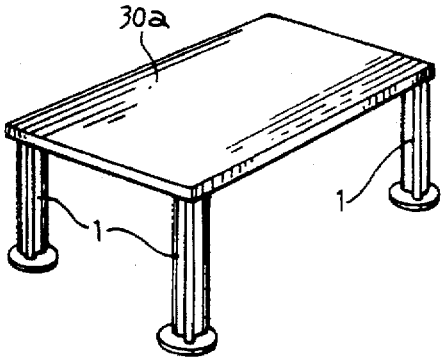

FIG. 11 shows an example of a table with four legs formed by uprights 1 to the tops of which a rectangular surface 30*a* is fixed.

Alternatively, several uprights 1 may be selected to constitute the support for complex arrangements of work surfaces, tables, desks and the like. In these arrangements, the same upright 1 may act as a common support for two or more adjacent work surfaces so as to constitute a nodal point which can be further equipped to constitute a complete furniture system.

Figure 12D:
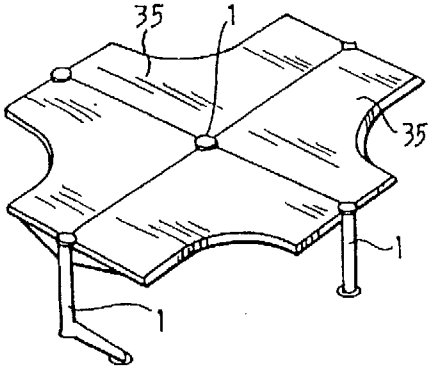
Figure 12C:
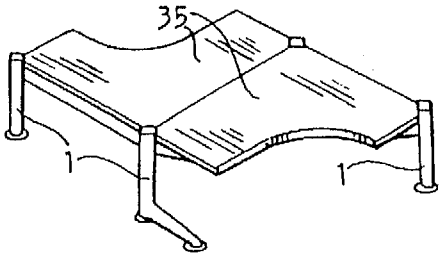
Figure 12B:
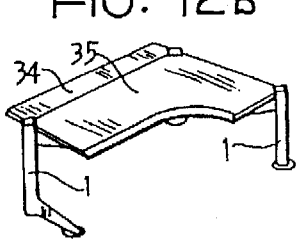
Figure 12A:
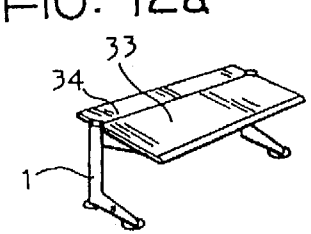
Figure 12F:
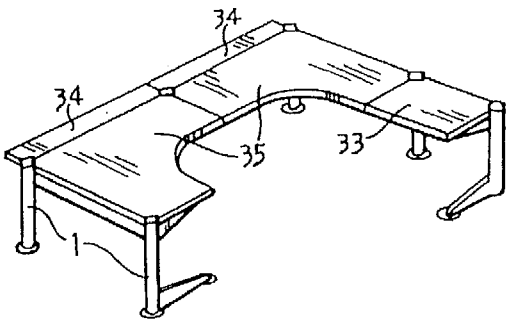
Figure 12E:
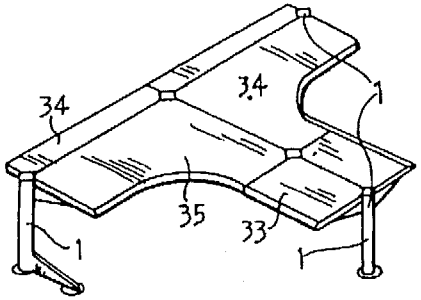
Figure 12G:
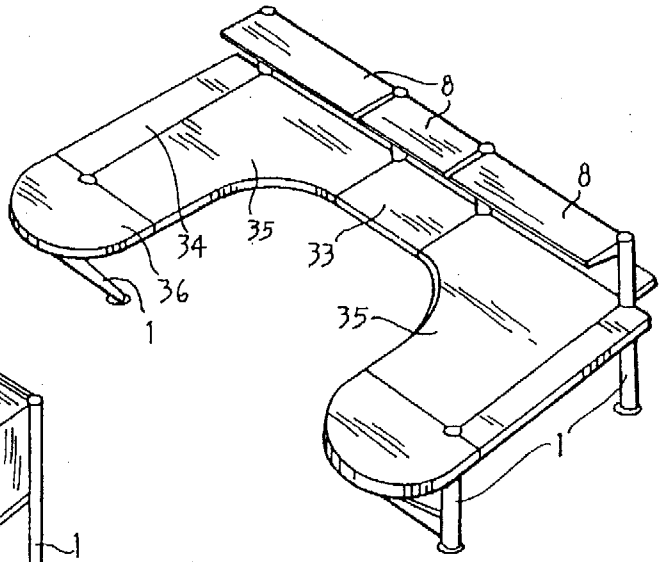
Figure 12I:
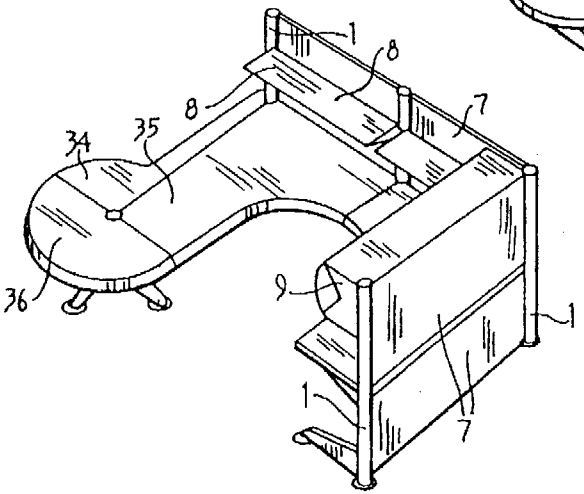
Figure 12H:
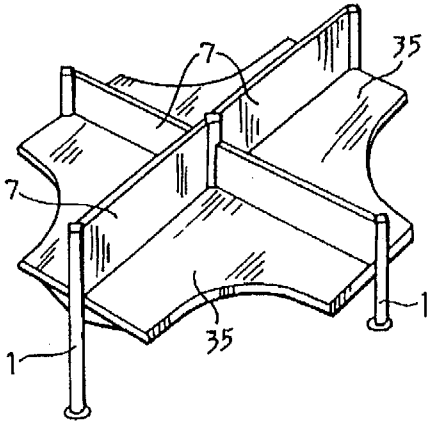

FIG. 12 shows some non-limiting examples of such work-surface arrangements, in particular:

- in FIG. 12*a*) two uprights 1 support a rectangular surface 33 and an extension 34 of the surface 33,
- in FIG. 12*b*) three uprights 1 support a shaped surface 35 and an extension 34,
- in FIG. 12*c*) four uprights 1 support two adjacent shaped surfaces 35,
- in FIG. 12*d*) five uprights 1 support four adjacent shaped surfaces 35 to form an island work station,
- in FIG. 12*e*) five uprights 1 support a combination of rectangular surfaces, shaped surfaces 35 and extensions 34 in an overall T-shaped arrangement.
- in FIG. 12*f*) six uprights 1 act as support elements for a C-shaped arrangement of work surfaces,
- in FIG. 12*g*) four uprights of a C-shaped arrangement, also including semi-circular end surfaces 36, extend upwards to support three shelves 8,
- in FIG. 12*h*) the uprights of an island work station such as 12*d*) extend upwards for the connection of four screens 7; in particular, tile central upright acts as a nodal point for the simultaneous connection of the four shaped surfaces 35 and of the four screens 7,
- in FIG. 12*i*) four of the five uprights 1 of a C-shaped arrangement of work surfaces extend upwards to support screens 7, shelves 8 and a suspended unit 9.

Figure 13:
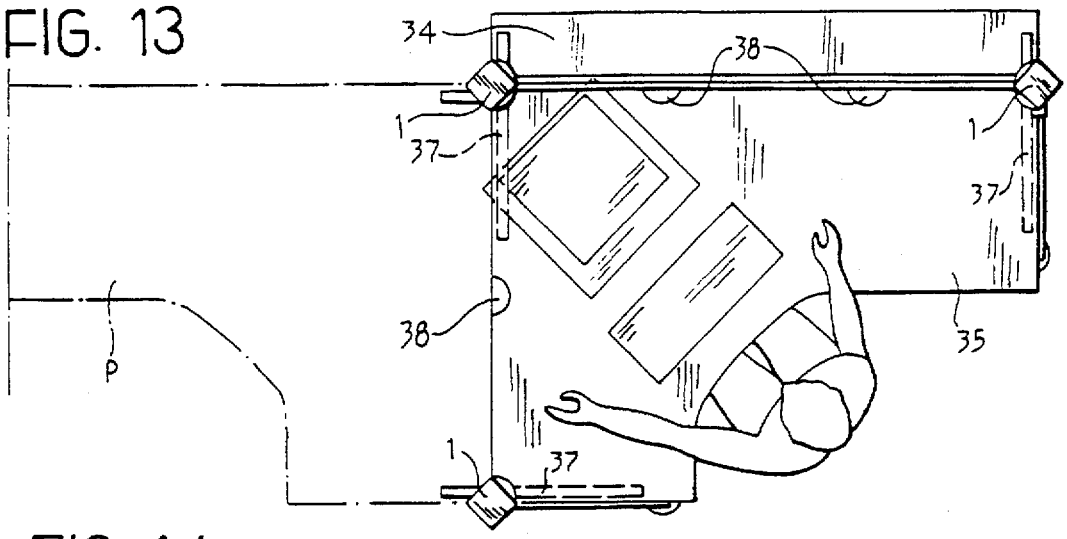

FIG. 13 shows the example 12*b* of FIG. 12 in greater detail. The vertical planes in which two adjacent uprights 1 lie are generally the planes of the structure with maximum bending stress. The assembly arrangement of the surface 35 and of the uprights 1 is such that the latter always have one of their cross-sections with greatest bending strength, defined by one of the two perpendicular axes along which two opposed pairs of arms 12 are directed, oriented for withstanding the maximum bending stress of the structure.

The shaped surface 35 is preferably connected to the uprights 1 with the interposition of the support brackets 37 fixed to the upright by means of one of the connection elements described above with reference to FIG. 4.

The surface extension 34, which is also fixed to the uprights 1, is mounted with its longer side beside one of the straight sides of the shaped surface 35 to form a continuous work surface. More generally, each of the surfaces 33, 34, 35, 36 of FIG. 12 can be placed beside another surface to form continuous flat surfaces of larger dimensions. The need to provide finishing strips for filling gaps between adjacent surfaces is thus eliminated.

Holes 38 which can be uncovered selectively are incorporated in the shaped surface 35 and, in general, in each work surface, to permit the passage of cables for data-transmission or electrical connections where necessary, as is also shown by way of example in FIG. 3.

The arrangements which can be achieved with the modular system of the present invention, which are shown in particular in FIGS. 3, 12 and 13, can be extended or modified even after the completion of a particular set of furniture without the need to disassemble the pre-existing structure. For example, another shaped surface P, shown in broken outline in FIG. 13, may be placed beside the shaped surface and fixed to two of the same uprights 1 supporting the first shaped surface 35 with the use of one or more of the slots or longitudinal grooves which are free on the uprights, for the connection.

Figure 14:
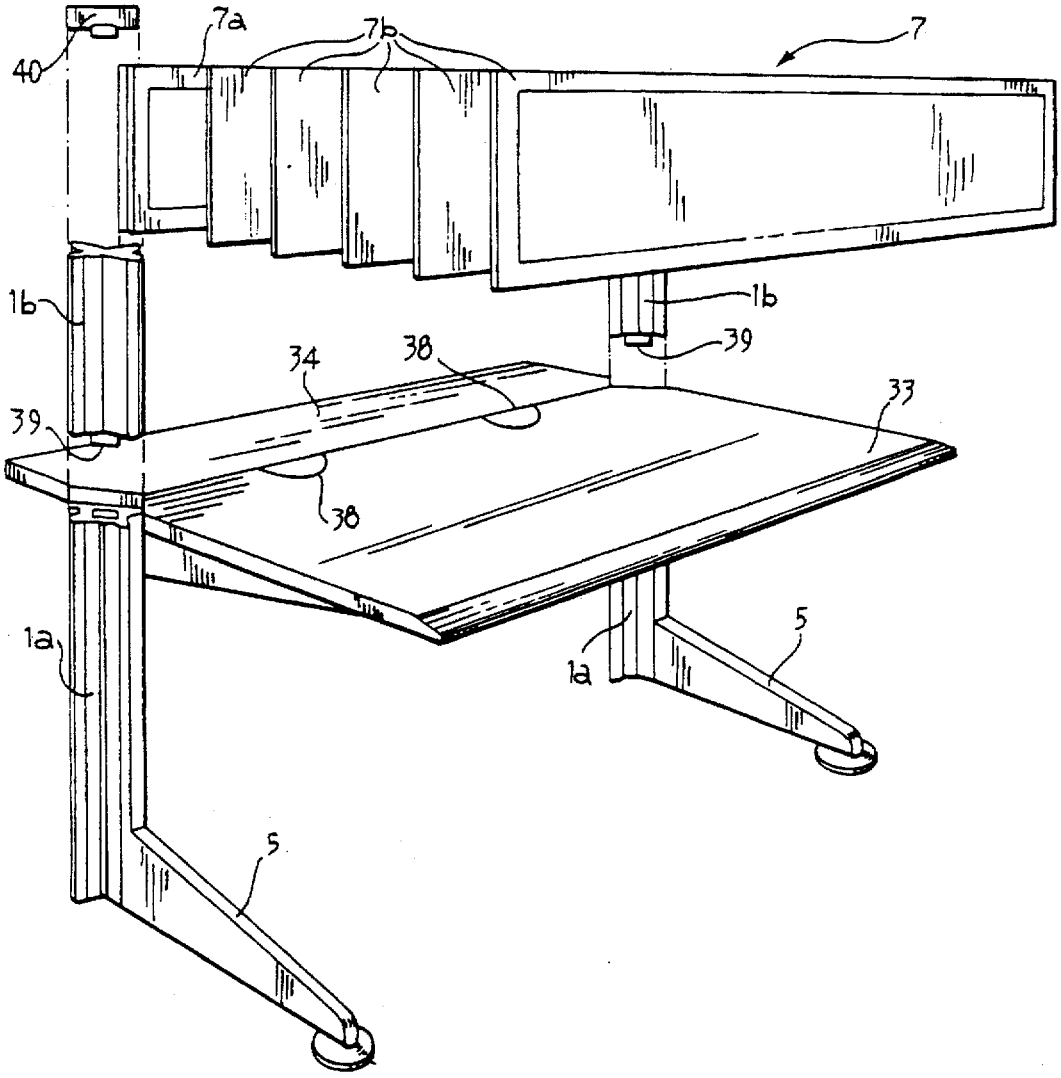

With reference now to FIG. 14, in a preferred embodiment, each upright 1 may comprise a lower portion 1*a* of a height equal to a predefined standard height of a work surface 33 for a person in a seated position and one or more upright portions lb which can selectively be engaged on one another and on the lower portion 1*a* to increase the overall height of the individual upright 1 so as to provide support for fixtures disposed at standard heights above the work surface, for example, such as the screens 7. The upright portions 1*b* are engaged on the lower portion 1*a* or on another portion 1*b* by means of expansion couplings 39, for example, of the type shown in FIG. 5, which engage the cavity inside the central core 13. The last portion of the upright element 1 can be closed at the top by a removable closure plug 40.

In a preferred embodiment, each screen 7 comprises a rectangular support framework 7*a* of which the vertical sides which are intended to be connected to the arms 12 of the uprights 1 carry one of the connection elements shown in FIG. 4, preferably the tensile connection element 20*a*. The opposite flat faces of the framework 7*a* can be covered, for example, by the inserting or jointing finishing panels 7*b*, for example, interchangeable drilled panels of wood, fabric, plastic-coated sheet metal, glass, windows or the like.

Figure 15:
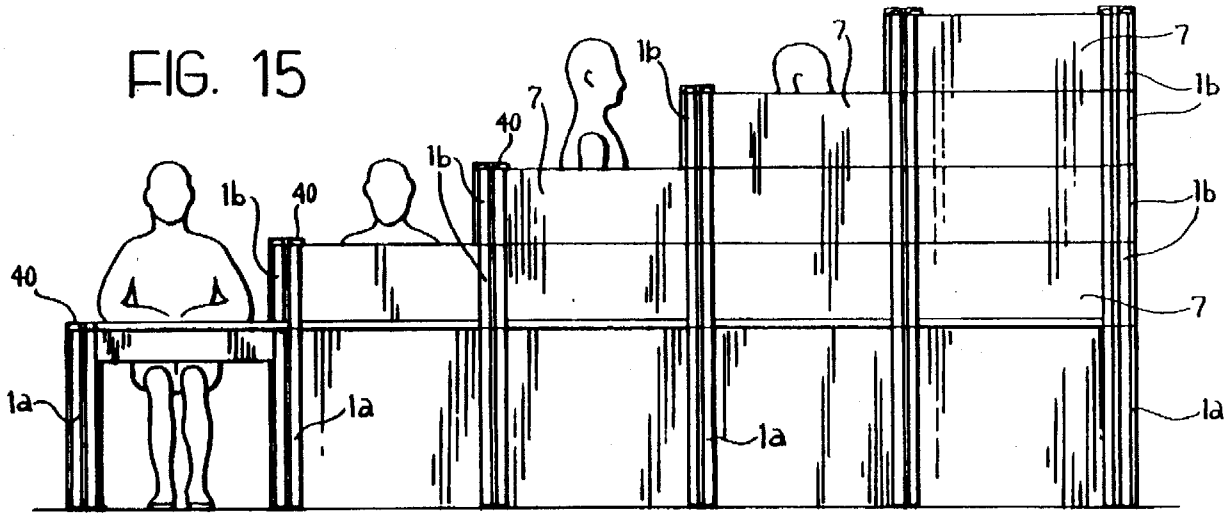
Figure 16:
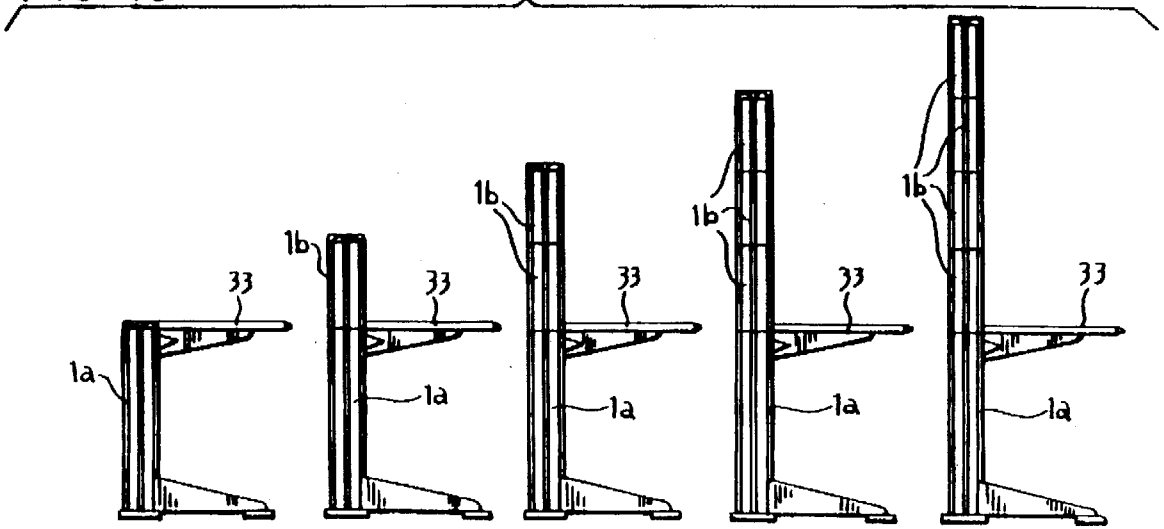

The appendages 21*a* of the tensile connection element 20*a* including the wedge-like pressure element 22*b* are inserted in the corresponding longitudinal grooves 15 of an arm 12 of the upright 1 so that the support framework 7*a* can slide vertically on the uprights 1 and can be clamped selectively thereto at an adjustable height. A plurality of frameworks 7*a* can be mounted on the same two uprights 1 to form screens of different heights, as shown in FIGS. 15 and 16.

What is claimed is:

1. A modular furniture system comprising:

at least one column-like upright element having a body which is elongate along a principal axis and two opposite ends substantially perpendicular to the principal axis, the upright element having a central core and radial projections and recesses distributed peripherally in alternation on the elongate body about the principal axis, said radial projections having base wall portions connected to the central core of the elongate body, the base wall portions of adjacent projections defining with a portion of said central core the recesses which extend along the elongate body of the upright element so as to define longitudinal slots, a plurality of fixtures which can be coupled selectively to the ends or to the body of the at least one upright element to form a furniture arrangement, the fixtures coupled to the body being adjustable continuously along the principal axis, and at least a first and a second connecting means for connecting the fixtures to the body of the at least one upright element, said first and second connecting means being selectively connectable in a respective position to any of the radial projections and the longitudinal slots, the first connecting means being connectable to any radial projection and adjustable continuously to any position along the principal axis of the upright element independently of the position of the second connecting means connected to an adjacent longitudinal slot.

2. A modular furniture system according to claim 1, wherein said radial projections have longitudinal grooves formed on opposite sides.

3. A modular furniture system according to claim 2, wherein said system comprises a plurality of upright elements and connecting means for connecting the fixtures to the bodies of the upright elements, said connecting means being selectively connectable to one of the radial projections, the grooves, and the longitudinal slots.

4. A modular furniture system according to claim 3, wherein said central core and said radial projections each have a central cavity and wherein said system comprises engagement and expansion connection means which can be coupled selectively with one of said cavity of said central core, said cavity in each of said arms and said longitudinal slots between said radial projections to connect fixtures to the ends of the upright element.

* * * * *